US007921836B2

(12) United States Patent
Tran

(10) Patent No.: US 7,921,836 B2
(45) Date of Patent: Apr. 12, 2011

(54) DUAL FEED ADAPTER OF PAINTBALL MARKER

(75) Inventor: Khanh Tran, San Jose, CA (US)

(73) Assignee: Real Action Paintball, Inc., San Jose, CA (US)

( * ) Notice: Subject to any disclaimer, the term of this patent is extended or adjusted under 35 U.S.C. 154(b) by 205 days.

(21) Appl. No.: 12/436,806

(22) Filed: May 7, 2009

(65) Prior Publication Data

US 2010/0282229 A1 Nov. 11, 2010

(51) Int. Cl.
*F41B 11/00* (2006.01)

(52) U.S. Cl. ..... 124/51.1; 124/49

(58) Field of Classification Search ..... 124/45, 124/48, 49, 51.1, 52
See application file for complete search history.

(56) References Cited

U.S. PATENT DOCUMENTS

| | | | | |
|---|---|---|---|---|
| 6,722,355 | B1 * | 4/2004 | Andrews, Jr. | 124/49 |
| 7,270,120 | B2 * | 9/2007 | Broersma et al. | 124/51.1 |
| 7,699,047 | B2 * | 4/2010 | Tippman et al. | 124/73 |
| 7,779,825 | B2 * | 8/2010 | Estrate | 124/49 |
| 2006/0180134 | A1 * | 8/2006 | Illuzzi | 124/74 |

* cited by examiner

*Primary Examiner* — Troy Chambers

(57) ABSTRACT

A paintball marker includes a main body and a dual feed adapter coupled to the main body. The dual feed adapter has a hollow interior, a top feed port and a bottom feed port. A top feed storage hopper is detachably connected to the dual feed adapter at the top feed port, and a bottom feed storage magazine is detachably connected to the dual feed adapter at the bottom feed port. A sleeve with an opening is rotatable within the dual feed adapter between a first position where the sleeve opening aligns with the top feed port for feeding therethrough a first group of paintballs from the hopper, and a second position where the sleeve opening aligns with the bottom feed port for feeding therethrough a second group of paintballs from the magazine.

19 Claims, 14 Drawing Sheets

DUAL FEED ADAPTER OF PAINTBALL MARKER

FIELD OF PATENT APPLICATION

The present patent application relates to a dual feed adapter of a paintball marker.

BACKGROUND

Paintball markers are used in paintball games. FIG. 1 shows a conventional paintball marker having a main body 8, a barrel 42, a bolt cover 45, an upper rail 61, a lower rail 22, a butt stock 62, a grip frame 63, and a bottom feed storage magazine 39 for storing paintballs. In a paintball game, a player can load into the bottom feed storage magazine expensive paintballs that are used only for accurate and long distance shots. However, the ammunition capacity of these conventional paintball markers is small so that players need to change the magazines frequently. Playing with these conventional paintball markers can be costly because the paintballs are expensive.

FIG. 2 shows another conventional paintball marker having a main body 8, a barrel 42, a feed neck 30, an upper rail 61, a lower rail 22, a butt stock 62, a grip frame 63, and a top feed storage hopper 41 for storing paintballs. This top feed storage hopper 41 has a big ammunition capacity so that players can make a lot of shots at targets. The paintballs used for paintball markers with top feed storage hoppers are usually for short distance shooting and are less expensive. However, playing with these conventional paintball markers can also be costly because more shots tend to be made. Furthermore, these conventional paintball markers with top feed storage hoppers can only make less accurate long distance shots.

The above description of the background is provided to aid in understanding a dual feed adapter of a paintball marker, but is not admitted to describe or constitute pertinent prior art to the dual feed adapter of a paintball marker disclosed in the present application, or consider any cited documents as material to the patentability of the claims of the present application.

SUMMARY

A paintball marker is provided. The paintball includes a main body and a dual feed adapter coupled to the main body. The dual feed adapter has a hollow interior, a top feed port and a bottom feed port. A top feed storage hopper is detachably connected to the dual feed adapter at the top feed port, and a bottom feed storage magazine is detachably connected to the dual feed adapter at the bottom feed port. A sleeve with an opening is rotatable within the dual feed adapter between a first position where the sleeve opening aligns with the top feed port for feeding therethrough a first group of paintballs from the hopper, and a second position where the sleeve opening aligns with the bottom feed port for feeding therethrough a second group of paintballs from the magazine.

BRIEF DESCRIPTION OF THE DRAWINGS

Specific embodiments disclosed in the present application will now be described by way of example with reference to the accompanying drawings wherein.

DETAILED DESCRIPTION

Figure 1:
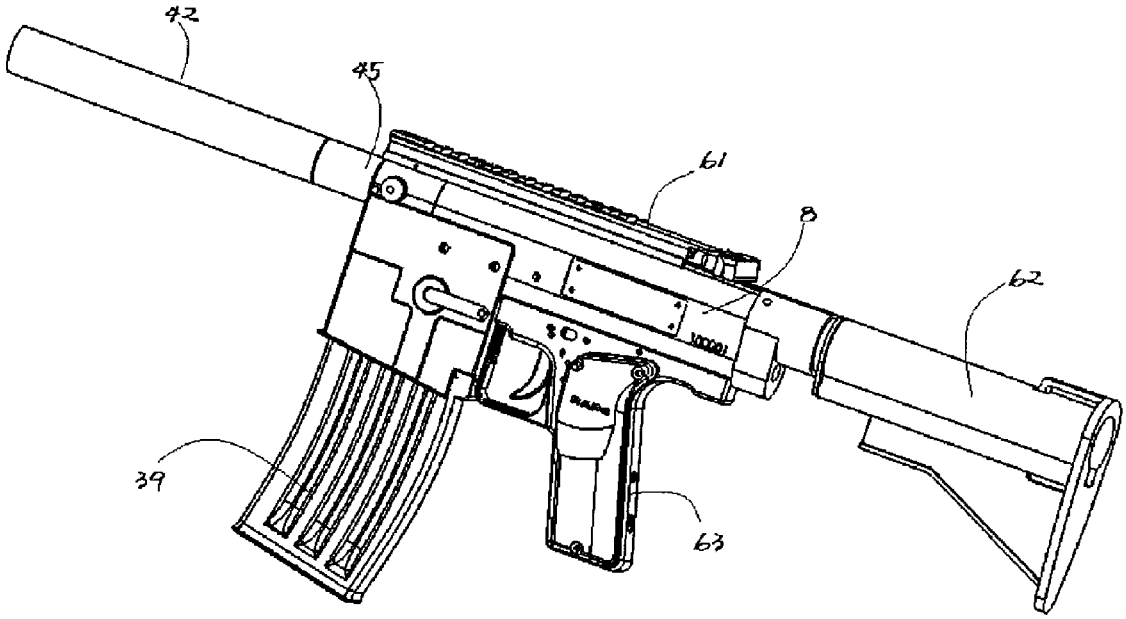
FIG.1(Prior Art)
FIG. 1 is a perspective view of a conventional paintball marker with a bottom feed storage magazine for storing paintballs.
Figure 2:
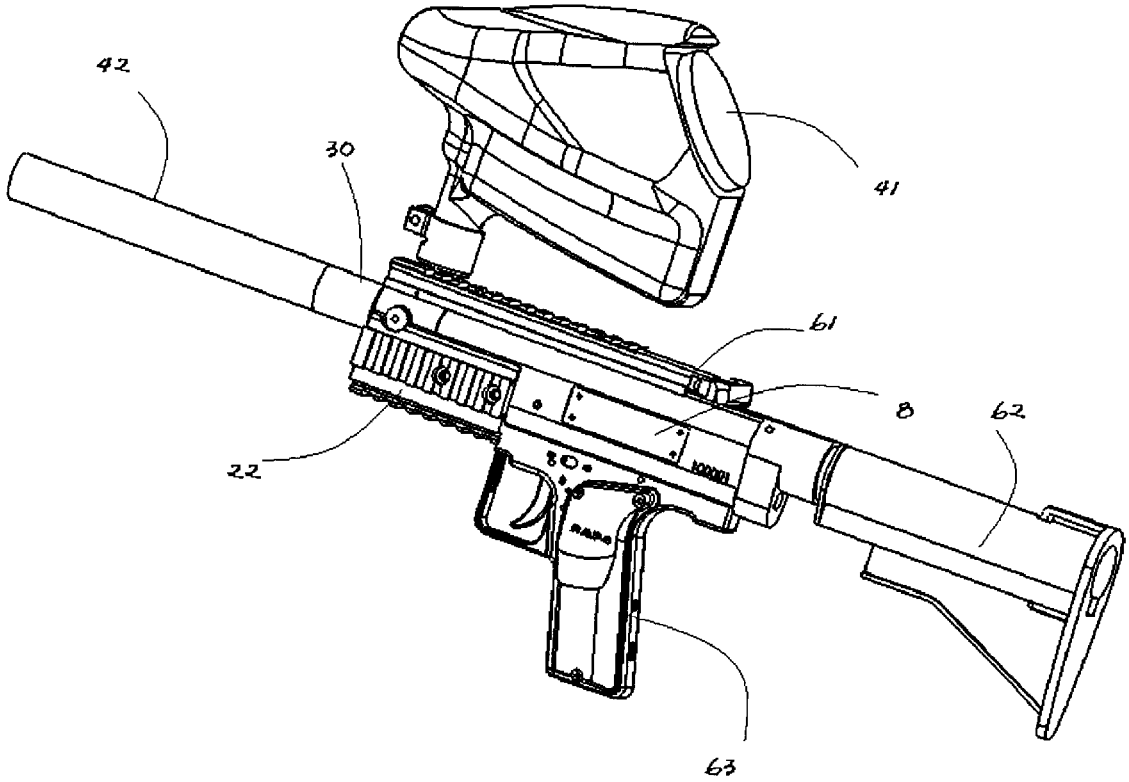
FIG.2(Prior Art)
FIG. 2 is a perspective view of a conventional paintball marker with a top feed storage hopper for storing paintballs.

Reference will now be made in detail to a preferred embodiment of a dual feed adapter of a paintball marker disclosed in the present application, examples of which are also provided in the following description. Exemplary embodiments of the dual feed adapter disclosed in the present application are described in detail, although it will be apparent to those skilled in the relevant art that some features that are not particularly important to an understanding of the dual feed adapter may not be shown for the sake of clarity.

Furthermore, it should be understood that the dual feed adapter disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims.

Certain terminology is used in the following description for convenience only and is not limiting. The words "upper", "lower", "top", "bottom", "inner" and "outer" designate directions in the drawings to which reference is made. The terminology includes the words noted above as well as derivatives thereof and words of similar import.

Figure 3:
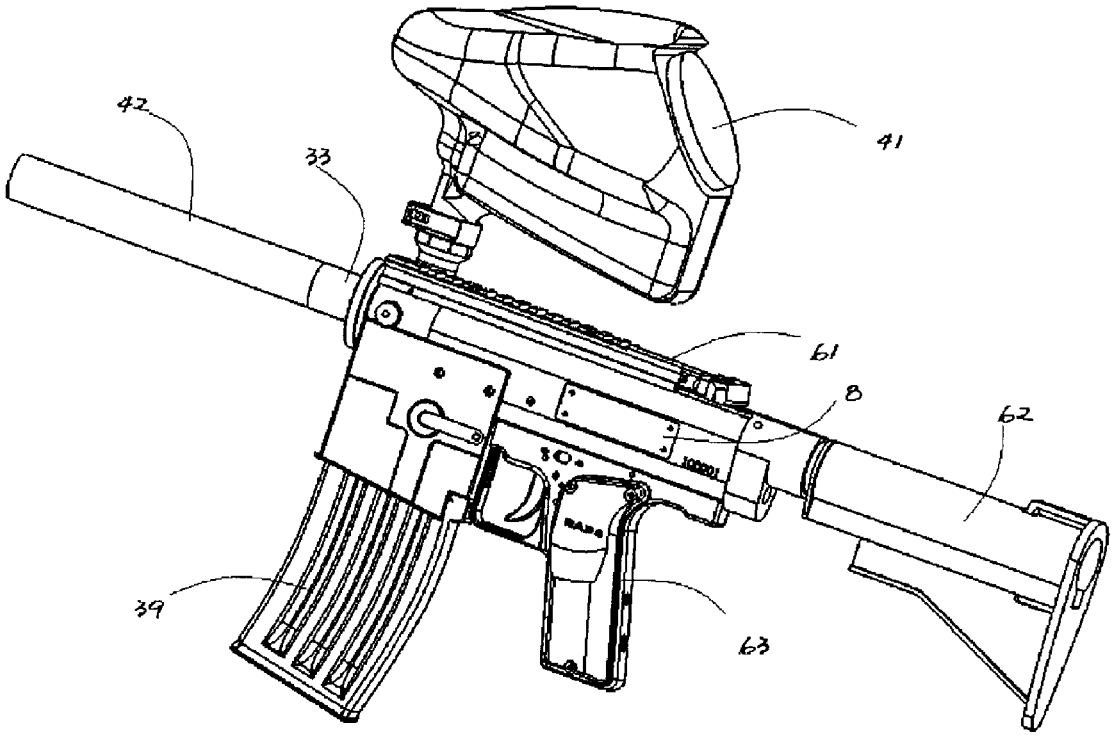
FIG. 3 is a perspective view of a paintball marker with a dual feed adapter according to an embodiment disclosed in the present application.
Figure 4:
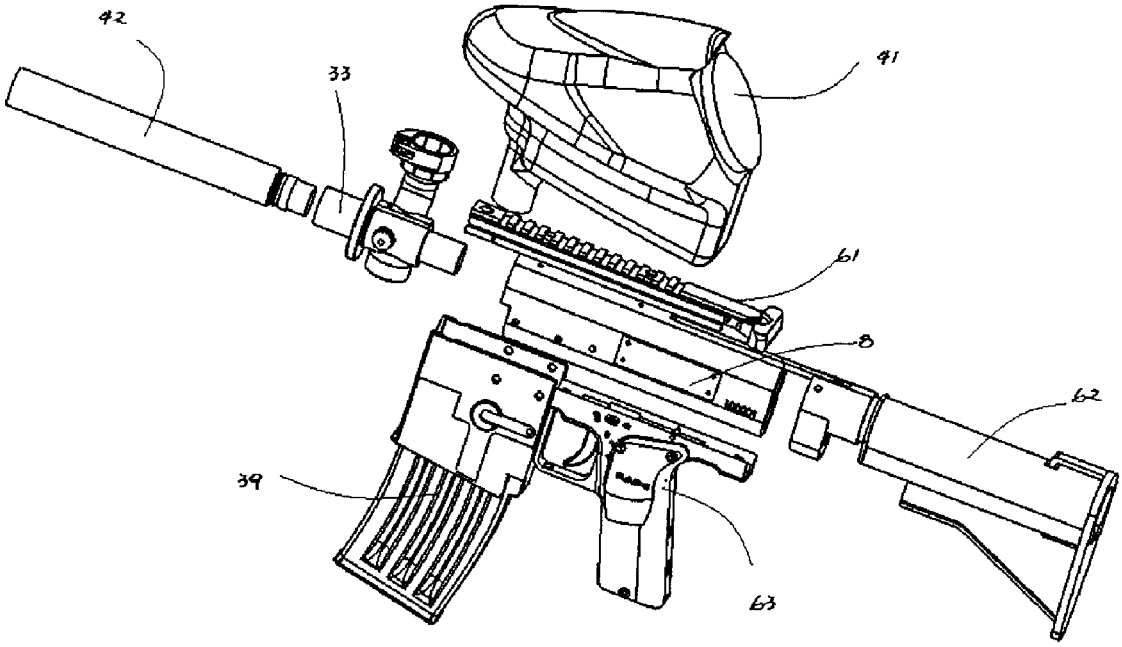
FIG. 4 is an exploded view of the paintball marker with dual feed adapter shown in FIG. 3.

FIG. 3 is a perspective view of a paintball marker with a dual feed adapter 33 according to an embodiment disclosed in the present application, and FIG. 4 is an exploded view of the paintball marker with the dual feed adapter 33. The dual feed design incorporates both the top storage hopper feeding and the bottom storage magazine feeding into one paintball marker. A player can select the feeding type either from a top feed storage hopper 41 or from a bottom feed storage magazine 39 by simply turning a selector wheel 25.

In a paintball game, a player can load inexpensive paintballs that are only used for short distance shots into the top feed storage hopper 41 and load expensive paintballs into the bottom feed storage magazine 39 that are only used for accurate long distance shots. This can maximize the paintball usage by allowing the player to select the right paintballs depending on the shooting range. The advantage is cost saving.

Figure 5:
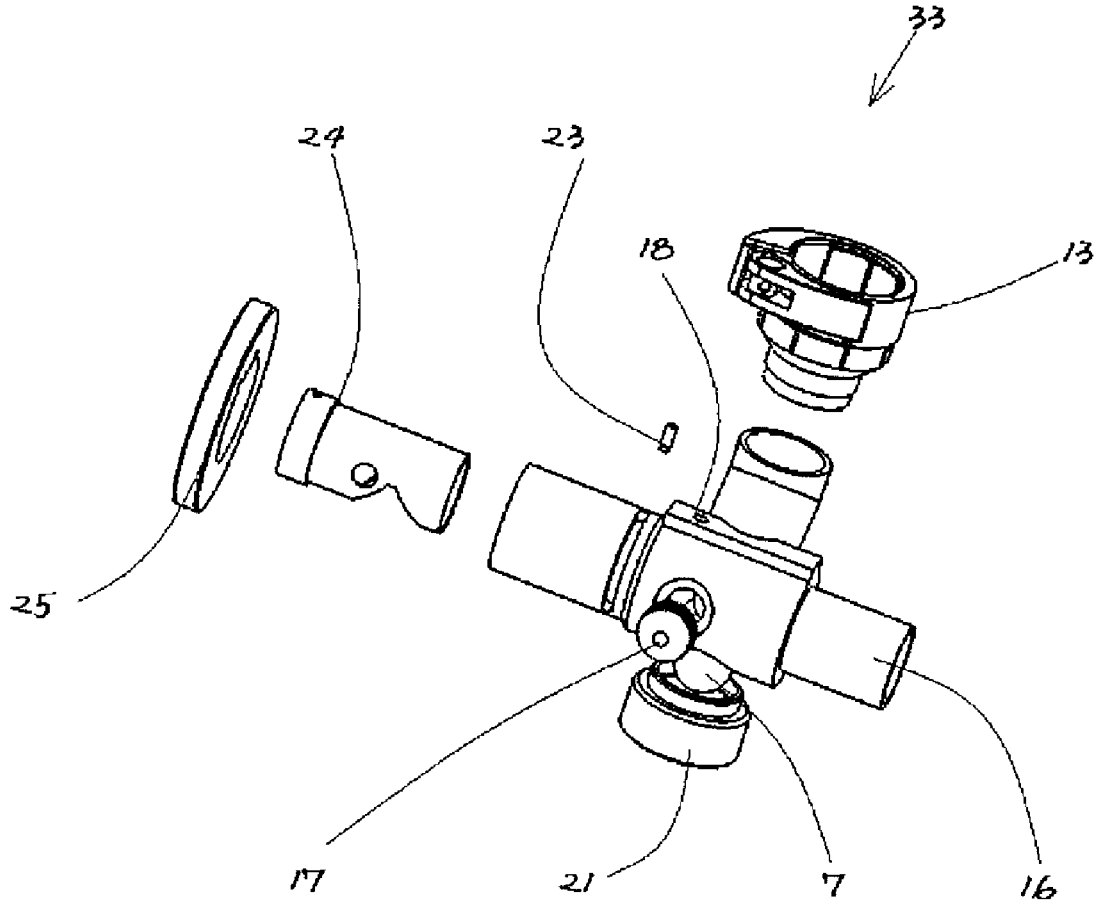
FIG. 5 is an exploded view of the dual feed adapter according to an embodiment disclosed in the present application.
Figure 5A:
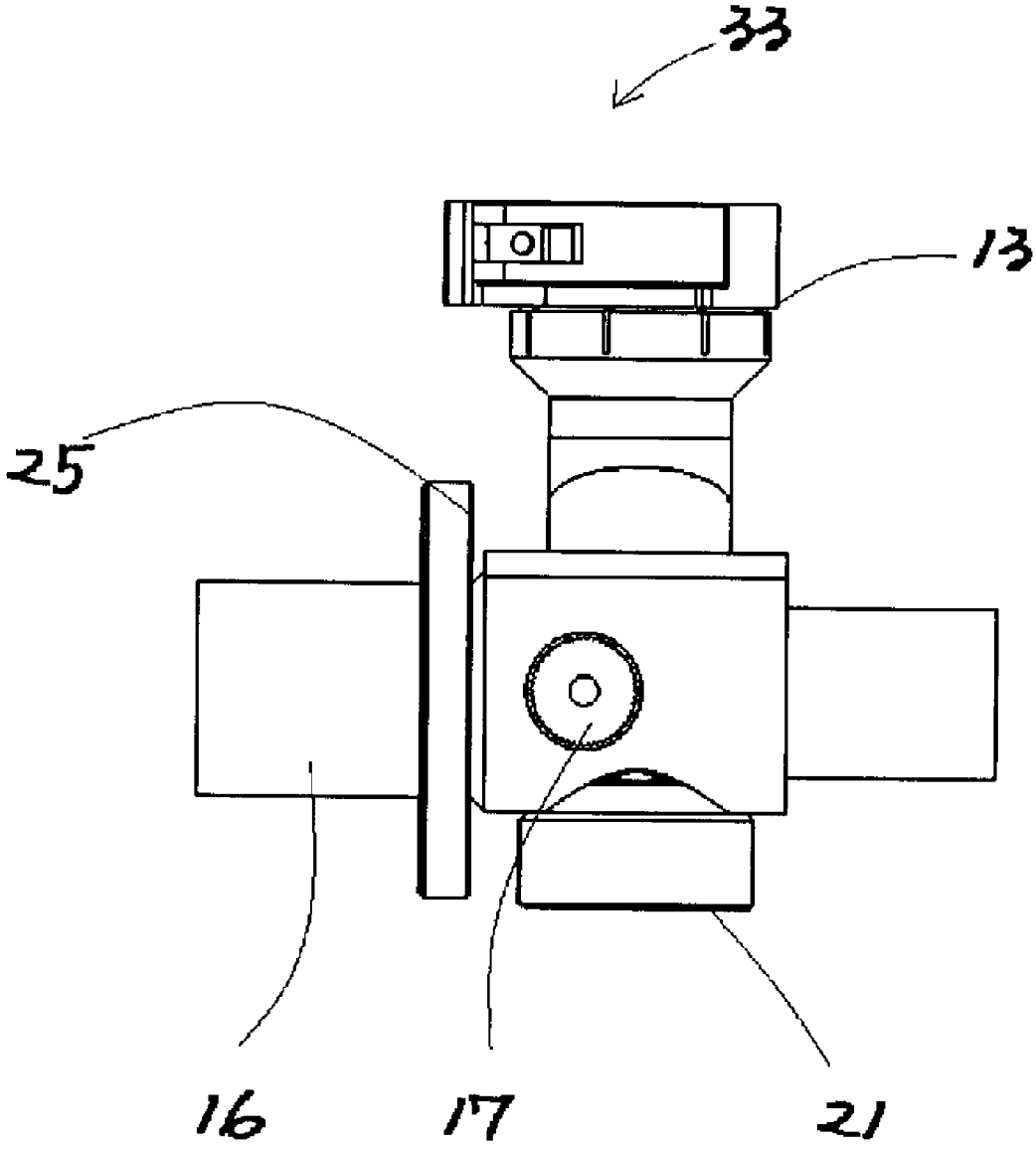
FIG. 5*a* is a side view of the dual feed adapter.
Figure 6:
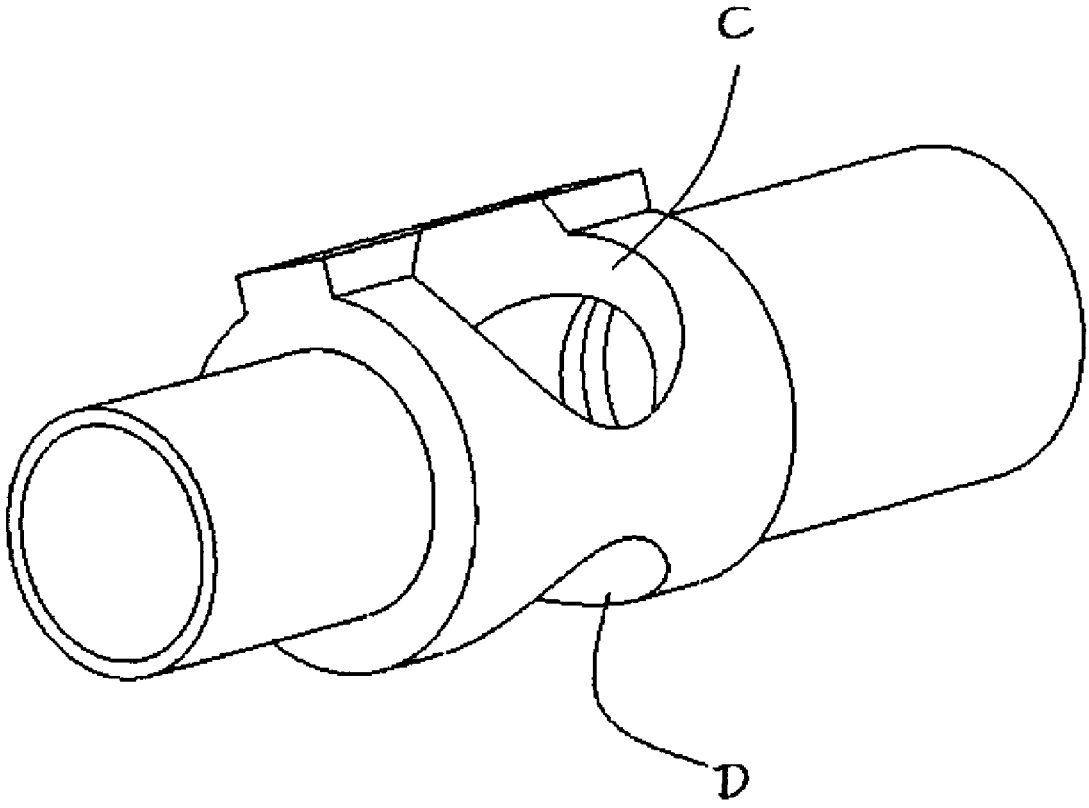
FIG. 6 is a perspective view of the two feed ports of the dual feed adapter.

FIG. 5 is an exploded view of the dual feed adapter 33 according to an embodiment disclosed in the present application, and FIG. 5*a* is a side view of the dual feed adapter 33. As best illustrated in FIG. 6, the dual feed adapter 33 may have a hollow interior, a top feed port C and a bottom feed port D. The top feed storage hopper 41 can be detachably connected to the dual feed adapter 33 at the top feed port C, and the bottom feed storage magazine 39 can be detachably connected to the dual feed adapter 33 at the bottom feed port D.

Figure 5B:
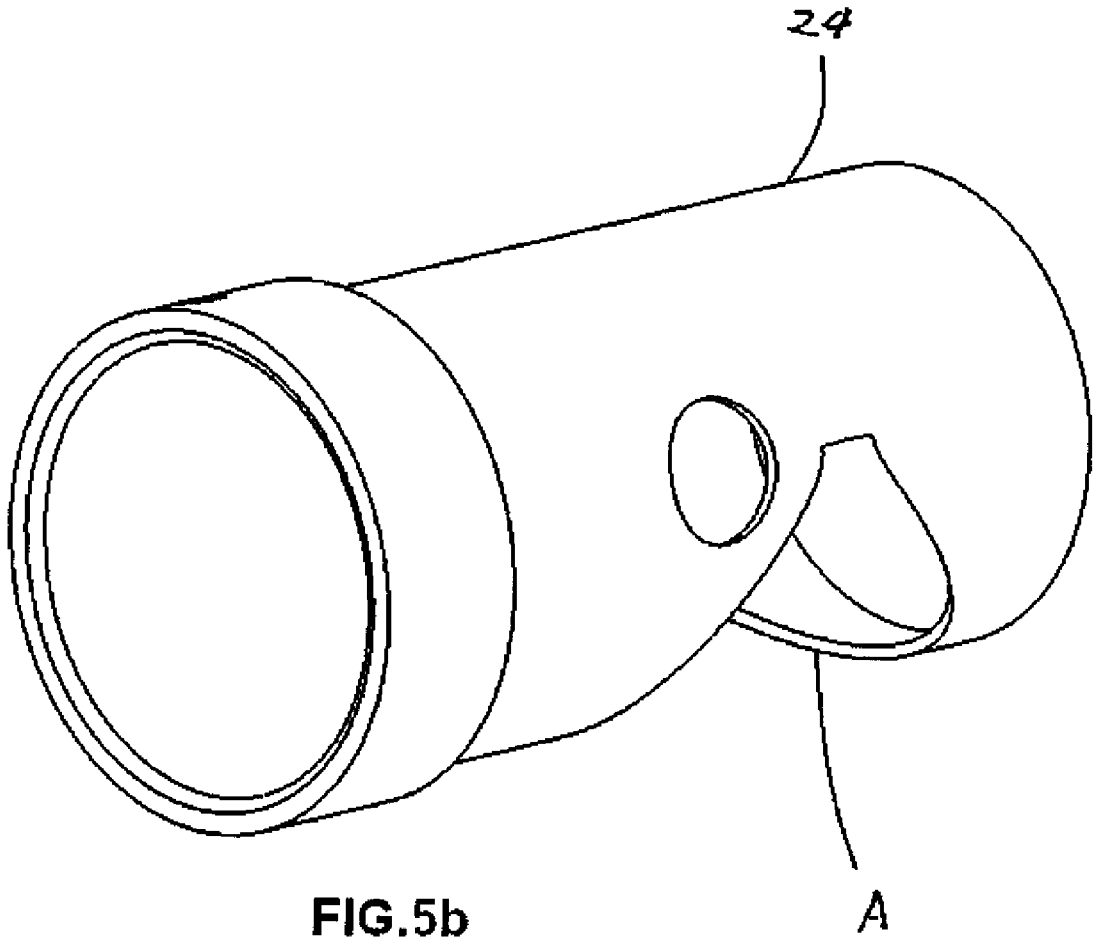
FIG. 5*b* is a perspective view of a cylindrical sleeve of the dual feed adapter.
Figure 7:
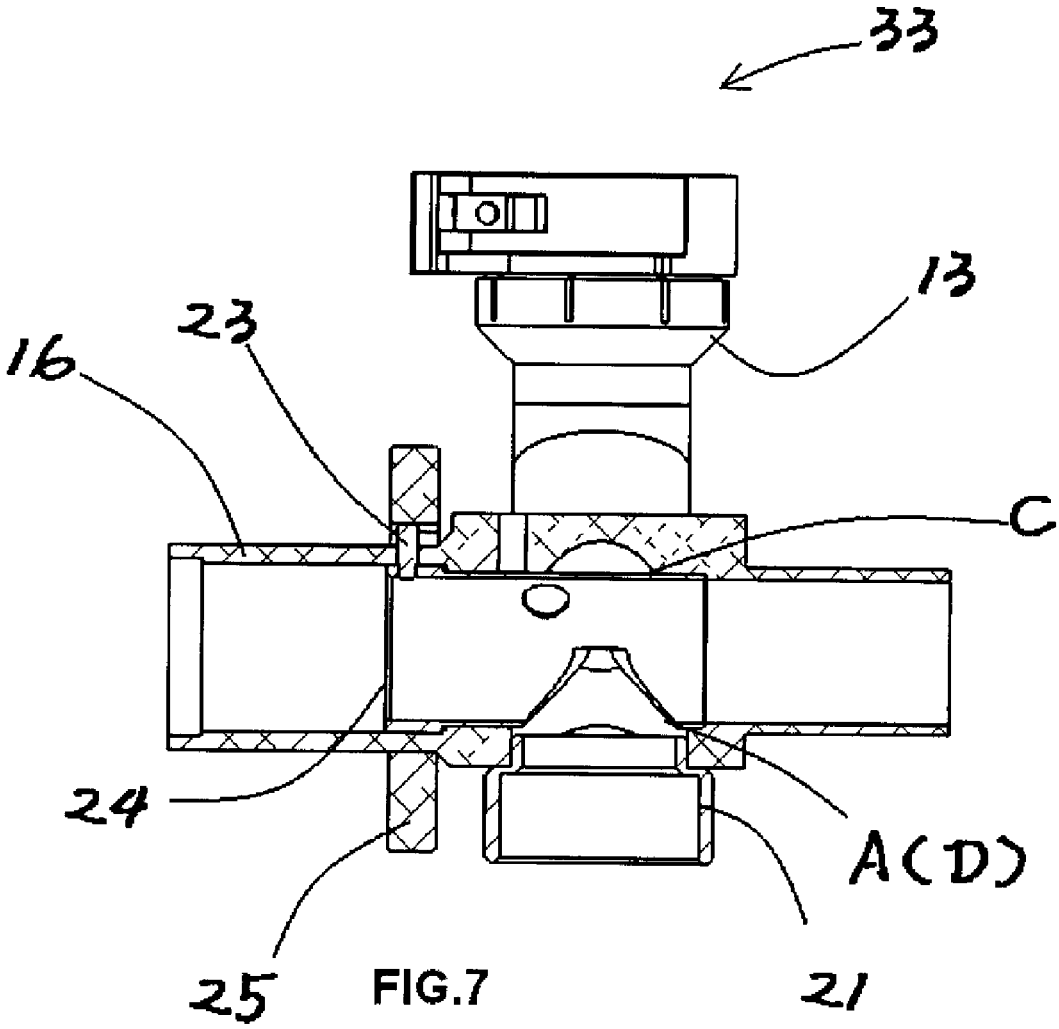
FIG. 7 is a partial cross sectional view of the dual feed adapter in a bottom feed position.
Figure 9:
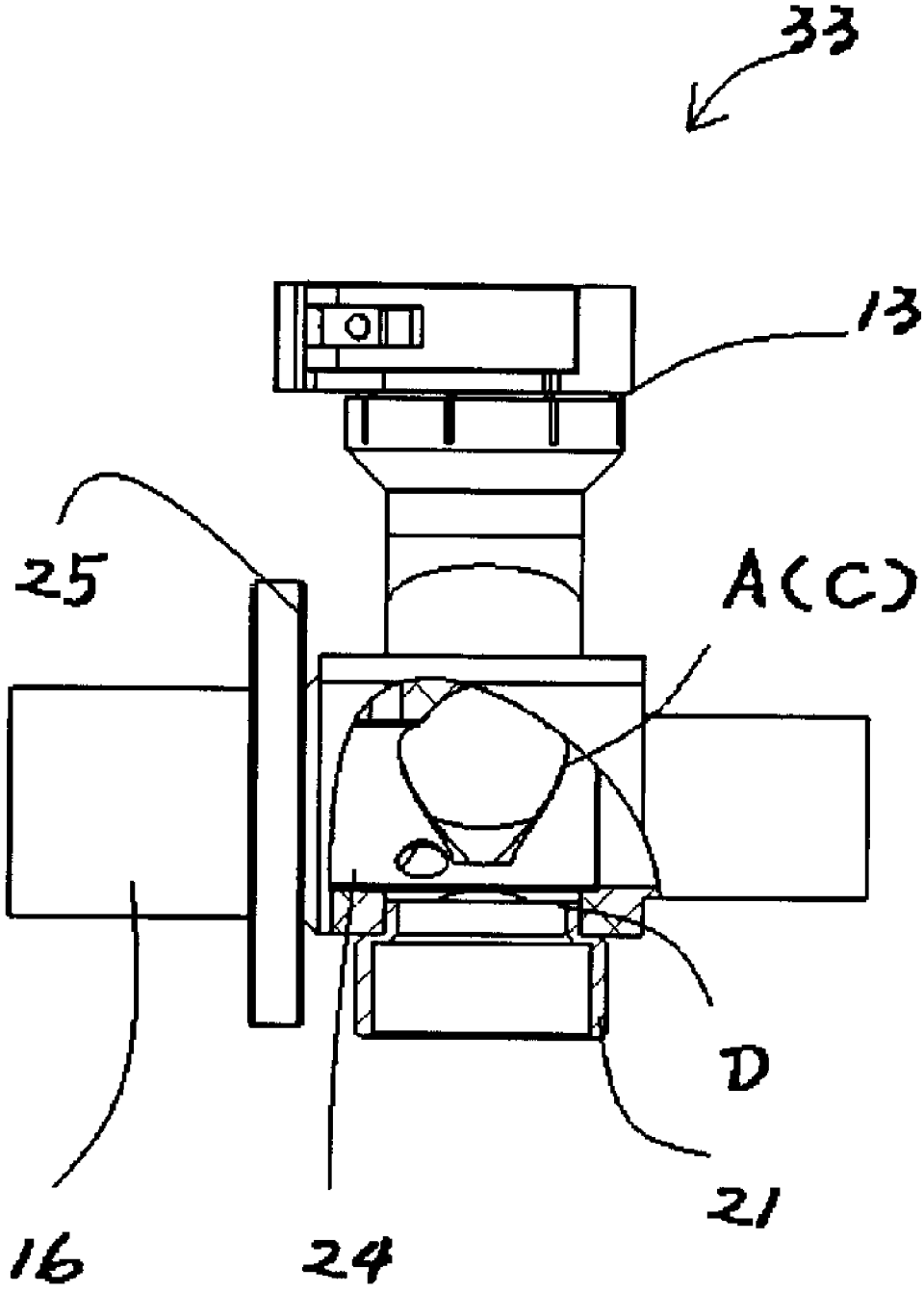
FIG. 9 is a partial cross sectional view of the dual feed adapter in a top feed position.

Referring to FIG. 5 and FIG. 5*b*, a cylindrical sleeve 24 can be rotatable within a cylindrical body 16 of the dual feed adapter 33. The sleeve 24 has an opening A. The sleeve 24 can be rotatable within the feed adapter body 16 between a first top feed position where the sleeve opening A aligns with the top feed port C for feeding therethrough a first group of paintballs 5 from the top feed storage hopper 41 (FIG. 9). A second bottom feed position where the sleeve opening A aligns with the bottom feed port D for feeding therethrough a second group of paintballs 7 from the bottom feed storage magazine 39 (FIG. 7).

Figure 5C:
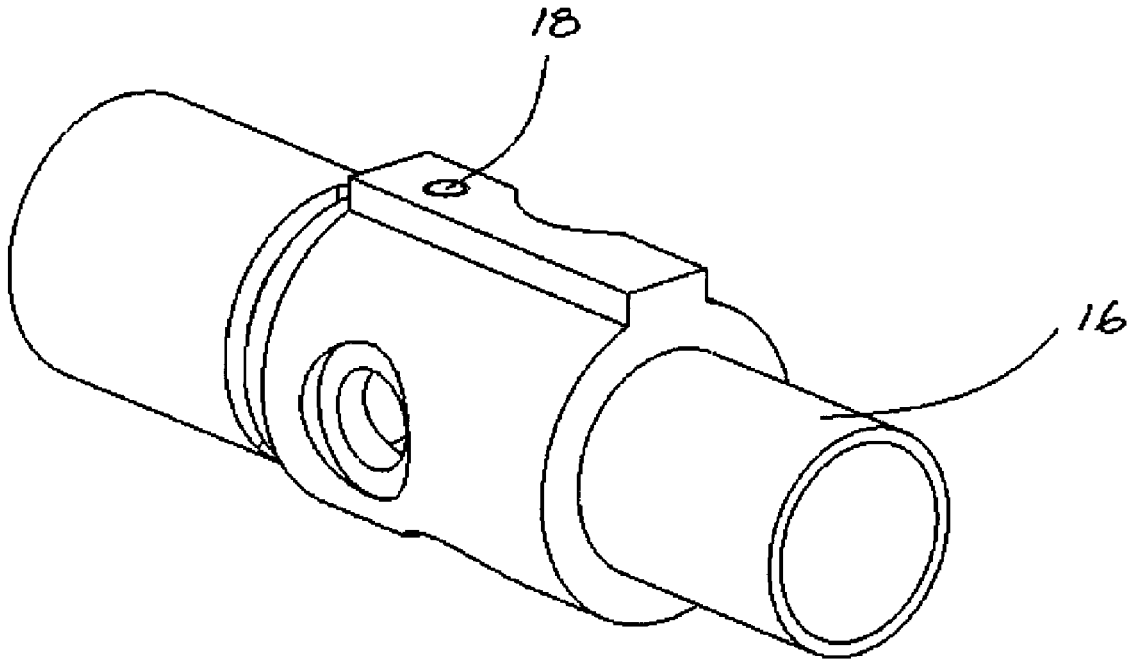
FIG. 5*c* is a perspective view of a feed adapter body of the dual feed adapter.
Figure 5D:
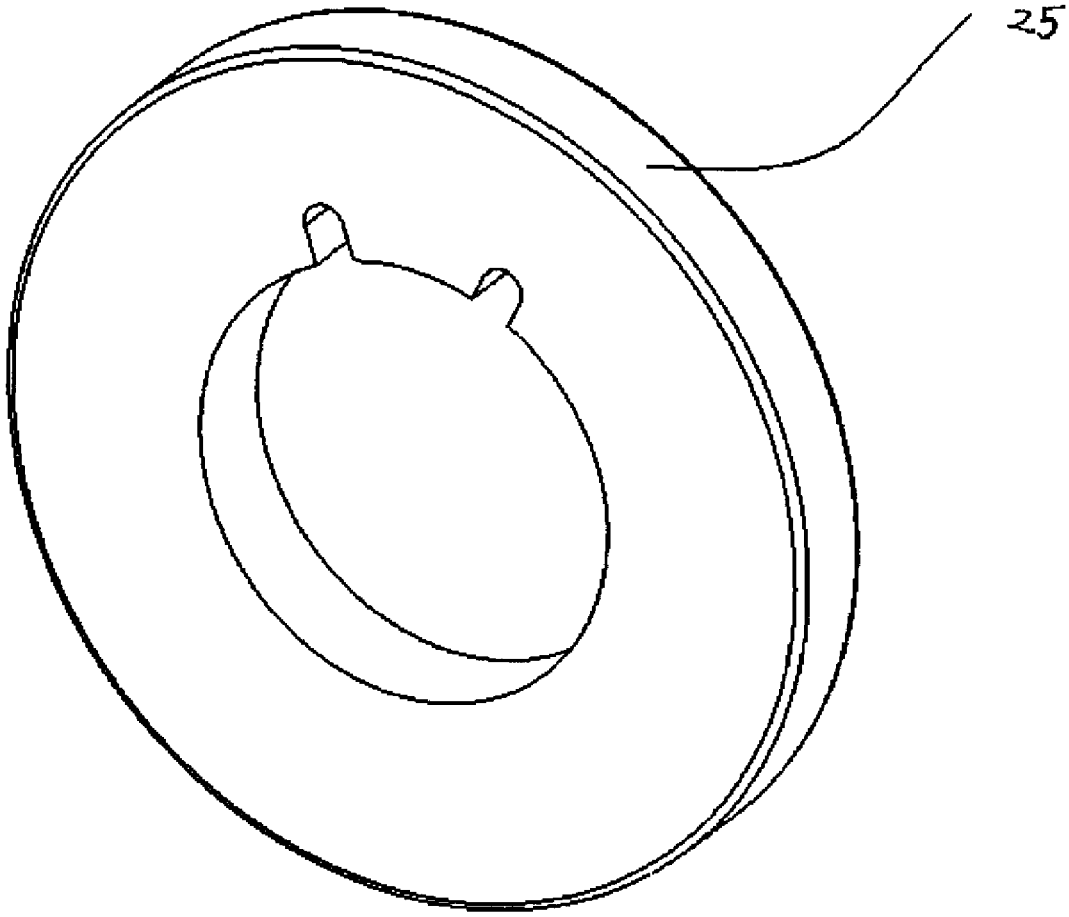
FIG. 5*d* is a perspective view of a selector wheel of the dual feed adapter.

Referring to FIG. 5 and FIG. 5*c*, a pin 23 can be fastened to the sleeve 24 and can be projecting from a slot 18 of the feed adapter body 16. Referring to FIG. 5 and FIG. 5*d*, a selector wheel 25 can be attached to the pin 23 and rotatable around the feed adapter body 16 so as to facilitate the rotation of the sleeve 24 between the top feed position and the bottom feed position. When the selector wheel 25 is turned, the sleeve 24 can be turned together.

A threaded ball detent 17 may be threadably engaged with a threaded side opening on the feed adapter body 16. The ball detent 17 may have an inner end adapted to press against the sleeve 24 for frictionally holding the sleeve 24 in a fixed position relative to the feed adapter body 16.

An upper feed adapter 13 may be employed to connect the top feed storage hopper 41 to the feed adapter body 16. Similarly, a bottom feed adapter 21 may by employed to connect the bottom feed storage magazine 39 to the feed adapter body 16. The upper feed adapter 13 and the bottom feed adapter 21 may be threadably engaged with the feed adapter body 16. The dual feed adapter 33 can be attached to a front end of the paintball marker main body 8.

A player can simply turn the selector wheel 25 to quickly select the paintballs 5 from the top feed storage hopper 41, or the paintballs 7 from the bottom feed storage magazine 39 for shooting in a paintball game without modification or changing of any parts.

Figure 8:
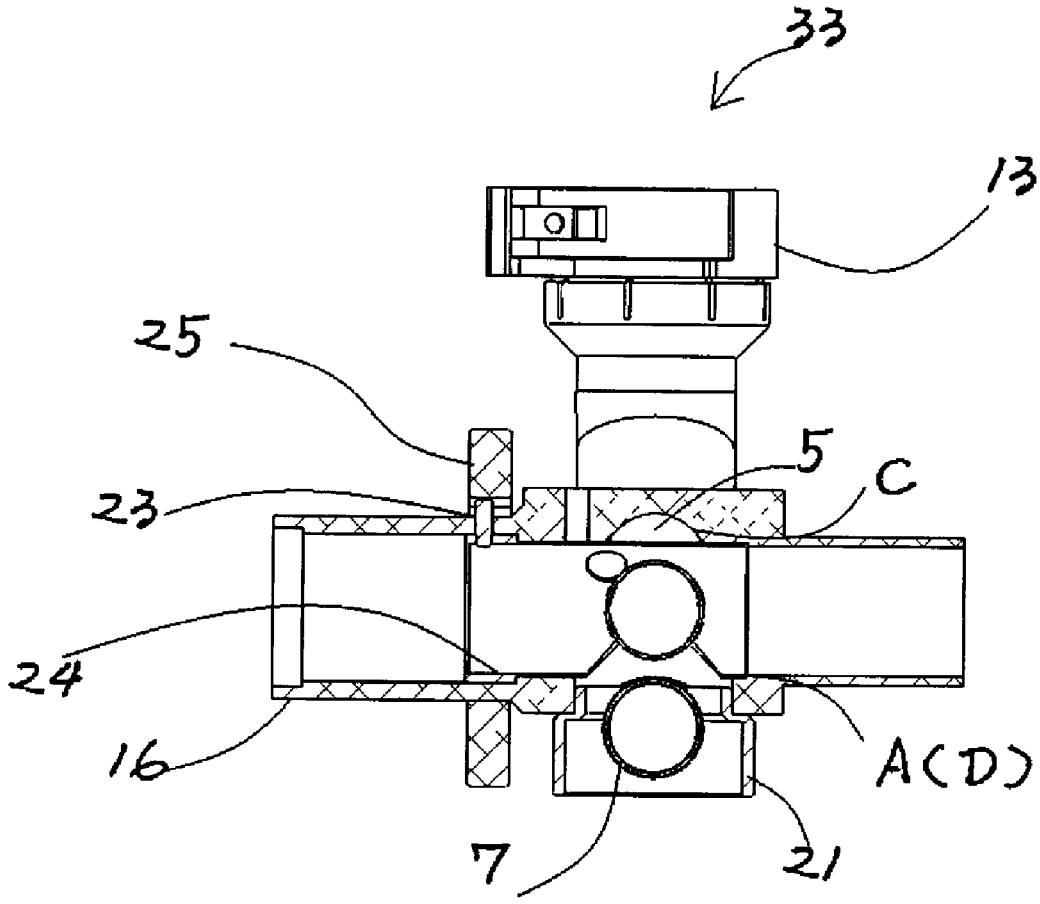
FIG. 8 is a partial cross sectional view of the dual feed adapter similar to FIG. 7 showing the bottom feeding of paintballs.

FIGS. 7 and 8 illustrate the feeding of paintballs 7 from the bottom feed storage magazine 39. To feed paintballs 7 from the bottom feed storage magazine 39, a player can loose the ball detent 17, turn the selector wheel 25 to align the opening A of the sleeve 24 with the bottom feed port D, and screw down the ball detent 17 in order to hold the sleeve 24 in a fixed position. The paintballs 7 from the bottom feed storage magazine 39 can enter into the sleeve 24. The player may select paintballs 7 from the bottom feed storage magazine 39 to make long distance shots in a paintball game. At this time, the top feed port C is blocked by the wall of the sleeve 24 so that the paintballs 5 from the top feed storage hopper 41 cannot enter into the sleeve 24.

Figure 10:
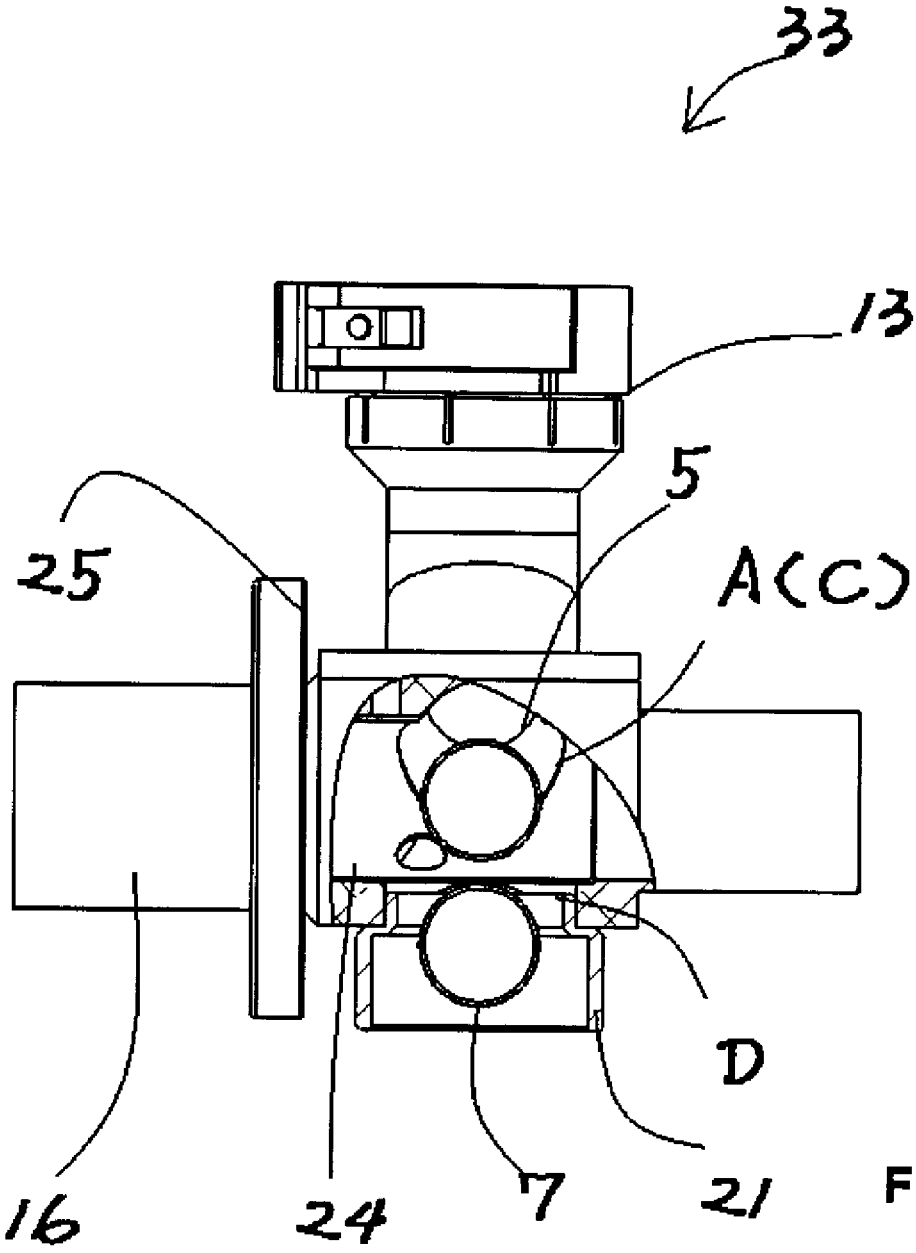
FIG. 10 is a partial cross sectional view of the dual feed adapter similar to FIG. 9 showing the top feeding of paintballs.

FIGS. 9 and 10 illustrate the feeding of paintballs 5 from the top feed storage hopper 41. To feed paintballs 5 from the top feed storage hopper 41, a player can loose the ball detent 17, turn the selector wheel 25 to align the opening A of the sleeve 24 with the top feed port C, and screw down the ball detent 17 in order to hold the sleeve 24 in a fixed position. The paintballs 5 from the top feed storage hopper 41 can enter into the sleeve 24. The player may select the paintballs 5 from the top feed storage hopper 41 to make short distance shots in a paintball game. At this time, the bottom feed port D is blocked by the wall of the sleeve 24 so that the paintballs 7 from the bottom feed storage magazine 39 cannot enter into the sleeve 24.

Although it has been shown and described that the top feed storage hopper 41 is connected to the dual feed adapter 33 at the top feed port C located at the top of the paintball marker, and the bottom feed storage magazine 39 is connected to the dual feed adapter 33 at the bottom feed port D located at the bottom of the paintball marker, it is understood by one skilled in the art that feed ports can be located on the side of the paintball marker.

While the dual feed adapter of a paintball marker disclosed in the present application has been shown and described with particular references to a number of preferred embodiments thereof, it should be noted that various other changes or modifications may be made without departing from the scope of the appending claims.

What is claimed is:

1. A paintball marker comprising:

(a) a main body;

(b) a dual feed adapter coupled to the main body, the dual feed adapter comprising a hollow interior, a first feed port and a second feed port;

(c) a feed storage hopper detachably connected to the dual feed adapter at the first feed port;

(d) a feed storage magazine detachably connected to the dual feed adapter at the second feed port; and (e) a sleeve comprising an opening, the sleeve being rotatable within the dual feed adapter between a first position where the sleeve opening aligns with the first feed port for feeding therethrough a first group of paintballs from the hopper, and a second position where the sleeve opening aligns with the second feed port for feeding therethrough a second group of paintballs from the magazine.

2. The paintball marker as claimed in claim 1, further comprising a selector wheel coupled to the sleeve to facilitate rotation of the sleeve within the dual feed adapter between the first and second positions.

3. The paintball marker as claimed in claim 1, further comprising a threaded ball detent threadably engaged with a threaded side opening of the dual feed adapter, the detent comprising an end adapted to press against the sleeve for frictionally holding the sleeve in a fixed position relative to the dual feed adapter.

4. The paintball marker as claimed in claim 1, wherein the first group of paintballs is less expensive than the second group of paintballs.

5. The paintball marker as claimed in claim 1, wherein the first group of paintballs is used for short distance shooting, and the second group of paintballs is used for long distance shooting.

6. The paintball marker as claimed in claim 1, wherein the feed storage hopper is attachable to a top side of the main body.

7. The paintball marker as claimed in claim 1, wherein the feed storage magazine is attachable to a bottom side of the main body.

8. A dual feed adapter of a paintball marker, the dual feed adapter comprising:

(a) a body comprising a hollow interior, a first feed port and a second feed port; and (b) a sleeve comprising an opening, the sleeve being rotatable within the body between a first position where the sleeve opening aligns with the first feed port for feeding therethrough a first group of paintballs from a first container, and a second position where the sleeve opening aligns with the second feed port for feeding therethrough a second group of paintballs from a second container.

9. The dual feed adapter as claimed in claim 8, further comprising a pin fastened to the sleeve and projecting from a slot of the body, and a wheel fastened to the pin and rotatable around the body to facilitate the rotation of the sleeve within the body between the first and second positions.

10. The dual feed adapter as claimed in claim 8, further comprising a threaded ball detent threadably engaged with a threaded side opening of the body, the detent having an inner end adapted to press against the sleeve for frictionally holding the sleeve in a fixed position relative to the body.

11. The dual feed adapter as claimed in claim 8, wherein the first position is a position where the sleeve opening is facing upwards, and the second position is a position where the sleeve opening is facing downwards.

12. The dual feed adapter as claimed in claim 8, wherein the first container is a feed storage hopper mounted on a top side of the body.

13. The dual feed adapter as claimed in claim 8, wherein the second container is a bottom feed storage magazine mounted on a bottom side of the body.

14. The dual feed adapter as claimed in claim 8, wherein the first group of paintballs is less expensive than the second group of paintballs.

15. The dual feed adapter as claimed in claim 8, wherein the first group of paintballs is used for short distance shooting, and the second group of paintballs is used for long distance shooting.

16. The dual feed adapter as claimed in claim 8, further comprising a first adapter for connecting the first container to the body, and a second adapter for connecting the second container to the body.

17. A paintball marker comprising:

(a) a main body;

(b) a dual feed adapter coupled to the main body, the dual feed adapter comprising a hollow interior, a first feed port and a second feed port;

(c) a feed storage hopper detachably connected to the dual feed adapter at the first feed port;

(d) a feed storage magazine detachably connected to the dual feed adapter at the second feed port;

(e) a sleeve comprising an opening, the sleeve being rotatable within the dual feed adapter between a first position where the sleeve opening aligns with the first feed port for feeding therethrough a first group of paintballs from the hopper, and a second position where the sleeve opening aligns with the second feed port for feeding therethrough a second group of paintballs from the magazine;

(f) a selector wheel coupled to the sleeve to facilitate rotation of the sleeve within the dual feed adapter between the first and second positions; and (g) a threaded ball detent threadably engaged with a threaded side opening of the dual feed adapter, the detent comprising an end adapted to press against the sleeve for frictionally holding the sleeve in a fixed position relative to the dual feed adapter.

18. The paintball marker as claimed in claim 17, wherein the feed storage hopper is attachable to a top side of the main body.

19. The paintball marker as claimed in claim 17, wherein the feed storage magazine is attachable to a bottom side of the main body.

* * * * *